US008056826B2

(12) United States Patent
Osler et al.

(10) Patent No.: US 8,056,826 B2
(45) Date of Patent: Nov. 15, 2011

(54) RAIL-MOUNTING ASSEMBLY

(75) Inventors: Wilbur F. Osler, Mattituck, NY (US); Scott D. Osler, Mattituck, NY (US)

(73) Assignee: Advanced Track Products, LLC, Mattituck, NY (US)

( * ) Notice: Subject to any disclaimer, the term of this patent is extended or adjusted under 35 U.S.C. 154(b) by 315 days.

(21) Appl. No.: 12/411,473

(22) Filed: Mar. 26, 2009

(65) Prior Publication Data

US 2009/0184172 A1 Jul. 23, 2009

Related U.S. Application Data

(63) Continuation-in-part of application No. 11/363,445, filed on Feb. 27, 2006, now Pat. No. 7,533,829.

(60) Provisional application No. 60/656,217, filed on Feb. 25, 2005.

(51) Int. Cl.
*E01B 9/00* (2006.01)

(52) U.S. Cl. ..... 238/264; 238/283; 238/282

(58) Field of Classification Search ..... 238/287, 238/306, 307, 349, 351, 382, 308, 279, 271, 238/283, 264, 269, 280
See application file for complete search history.

(56) References Cited

U.S. PATENT DOCUMENTS 4,715,533 A * 12/1987 Bucksbee et al. ..... 238/283

* cited by examiner

*Primary Examiner* — Mark Le
(74) *Attorney, Agent, or Firm* — Andrew Wilford

(57) ABSTRACT

A rail-mounting assembly has a base frame formed unitarily with a pair of side members and a pair of end members generally bridging ends of the side members and having inwardly directed generally vertical inner end faces. At least one web extending horizontally between the members has a horizontal upper face and defines with the members a vertically throughgoing aperture. A top plate spaced above the base frame has a lower face having a portion spacedly vertically confronting the upper face of the web and a pair of outwardly directed outer end faces longitudinally horizontally confronting the inner end faces of the end members. An elastomeric body is bonded to each of the outer end faces and the respective confronting inner end face and to the upper face of the web and the portion of the lower face confronting the upper face.

15 Claims, 6 Drawing Sheets

RAIL-MOUNTING ASSEMBLY

CROSS REFERENCE TO RELATED APPLICATION

This application is related to application Ser. No. 11/363,445 filed 27 Feb. 2006 now U.S. Pat. No. 7,533,829, with a claim to the priority of provisional application 60/656,217 filed 25 Feb. 2005.

FIELD OF THE INVENTION

The present invention relates to a rail-mounting assembly of the type in which a metal top plate is received in a base frame that is attached to a sleeper or rail bed and a cushion sheet of elastomer bonded to both the top plate and the base frame is provided between the juxtaposed faces of the two parts.

BACKGROUND OF THE INVENTION

Successful rail mounting assemblies are disclosed in U.S. Pat. No. 6,789,740 and to U.S. Pat. No. 6,986,470. In these rail mounting assemblies which can be referred to as "egg" designs, the frame has a generally elongated or oval opening formed at its ends with inclined faces and four lugs symmetrically disposed at opposite ends of the frame to receive bolts for attachment of the base plate to the support structure.

The top plate is also symmetrical about the longitudinal axis and has at its ends inclined faces juxtaposed with the inclined faces of the frame and bonded, e.g. by vulcanization, to the elastomer sheet received between the juxtaposed faces and extending around the sides of the top plate and the frame. The bonding is at the inclined end faces only so that there is shear action here as well as compression to simultaneously cushion and limit relative movement of the top plate and base frame. Such track fasteners are particularly useful for vibration-sensitive locations.

In the known systems the elastomer sheet is largely unexposed and unsupported on the base frame except at the angled end faces. Even where some structure of the base frame may extend underneath the elastomer sheet other than at these angled end faces there is no bonding of the sheet to the base frame and/or top frame as the sole function of the sheet in this region is to undergo compression.

OBJECT OF THE INVENTION

The principal object of the present invention is to provide an improved system-wide track fastener or rail-mounting assembly that has some of the advantages of the designs described in the two cited patents and parent application and to make the rail-mounting assembly more universally applicable and acceptable.

Another object is to provide a track fastener that is an improvement over traditional two-bolt fasteners currently available for systemwide application.

SUMMARY OF THE INVENTION

A rail-mounting assembly has according to the invention a base frame formed unitarily with a pair of transversely spaced and longitudinally extending side members and a pair of longitudinally spaced and transversely extending end members generally bridging ends of the side members and having longitudinally inwardly directed generally vertical inner end faces. At least one web extending horizontally between the members has a substantially horizontal upper face and defines with the members at least one vertically throughgoing aperture. A top plate spaced above the base frame has a downwardly directed lower face having a portion spacedly vertically confronting the upper face of the web and a pair of respective longitudinally outwardly directed generally vertical outer end faces longitudinally spacedly horizontally confronting the inner end faces of the end members. An elastomeric body substantially fills between and is bonded to each of the outer end faces and the respective confronting inner end face. It also fills between and is bonded to the upper face of the web and the portion of the lower face confronting the upper face.

This system therefore has a solid vertical bond between horizontal surfaces of both to the top plate and base frame. This additional bonding, which is not present in the prior-art systems, provides excellent protection against liftoff, for instance when the assembly is used on a corner.

According to the invention the web extends transversely between the side members spacedly between the end members and defines one such aperture with each of the end members. In addition the web is centrally located between the two end members, and the web upper face is upwardly convex while the portion of the lower face is complementarily downwardly concave.

According to another embodiment of the invention there are two such webs and the aperture is between the two webs. Each of the webs forms a longitudinal inward extension of the respective end member, and each web has a planar upper face and the lower face has two such portions that are also planar.

The end faces according to the invention form small acute angles with the vertical. The body is bonded to the plate and frame by vulcanization, and the plate and frame are of steel.

BRIEF DESCRIPTION OF THE DRAWING

The above and other objects, features, and advantages will become more readily apparent from the following description, reference being made to the accompanying drawing in which.

SPECIFIC DESCRIPTION

Figure 4:
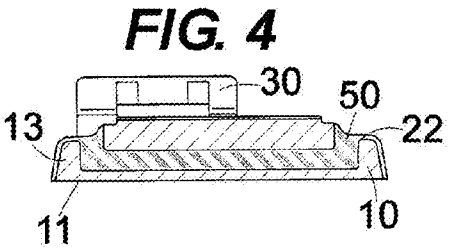
FIGS. 4 and 5 are cross sections along respective line IV-IV and V-V of FIG. 1 through the assembly.
Figure 5:
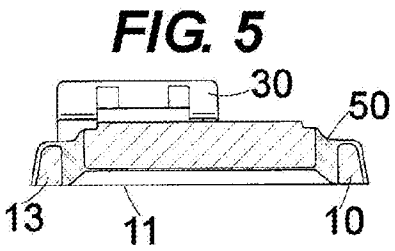
Figure 2:
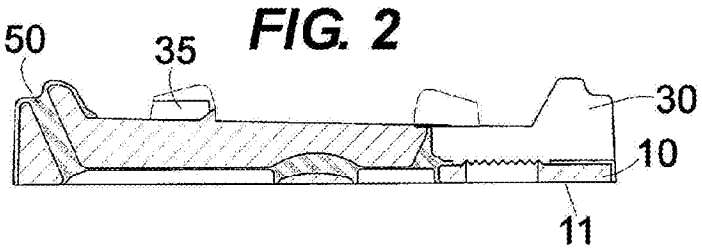
FIG. 2 is a vertical longitudinal section along line II-II of FIG. 1 through the assembly.
Figure 3:
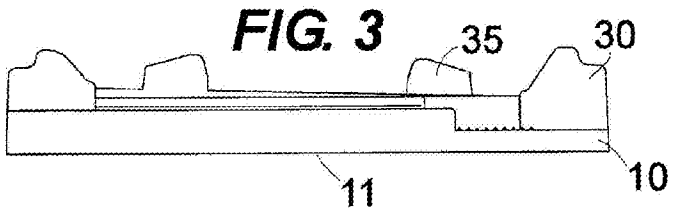
FIG. 3 is a side elevational view in the direction of arrow III of the assembly.
Figure 1:
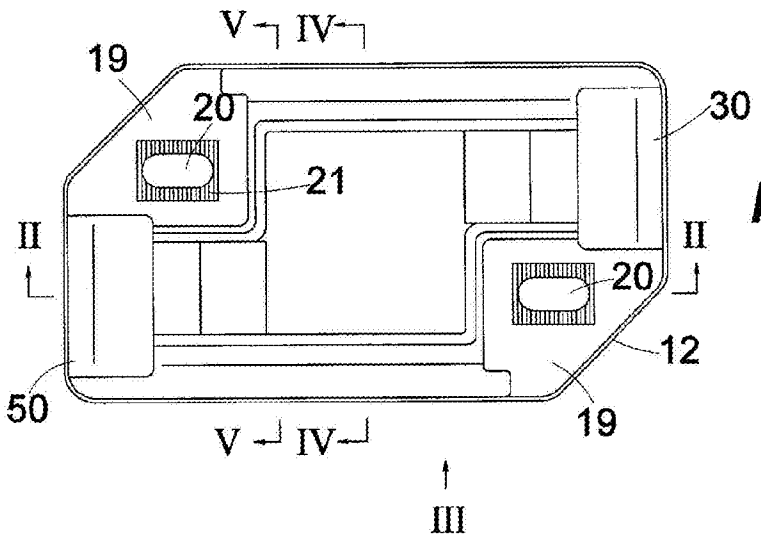
FIG. 1 is a top view of an assembly according to the invention.

As seen in FIGS. 1-5 a rail-mounting assembly according to the invention comprises a cast-metal base frame 10, a cast-metal top plate 30 and a one-piece sheet or body 50 of elastomeric material bonded to the top plate 30 and to the base frame 10.

Figure 10:
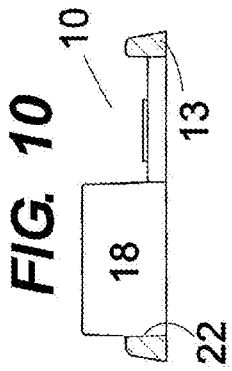
FIG. 10 is a cross section taken along line X-X of FIG. 6.
Figure 11:
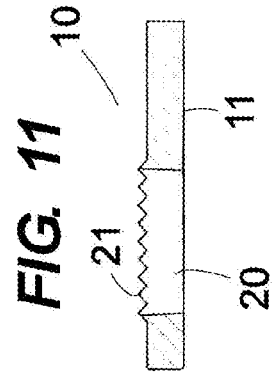
FIG. 11 is a large-scale cross section taken along line XI-XI of FIG. 6.
Figure 8:
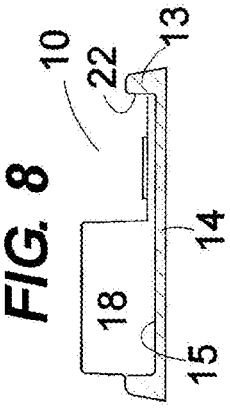
FIGS. 7 and 8 are longitudinal and cross sections along respective lines VII-VII and VIII-VII of FIG. 6.
Figure 9:
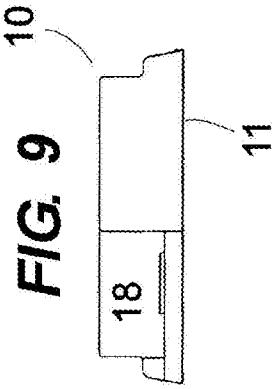
FIG. 9 is an end view in the direction of arrow IX of FIG. 6.
Figure 7:
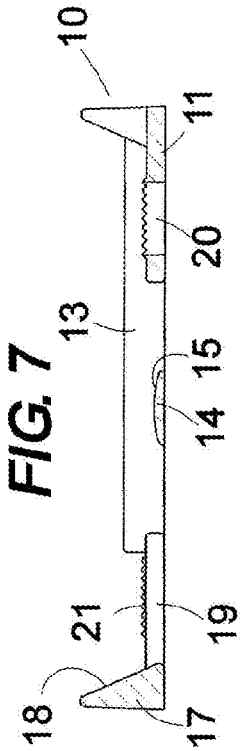
Figure 6:
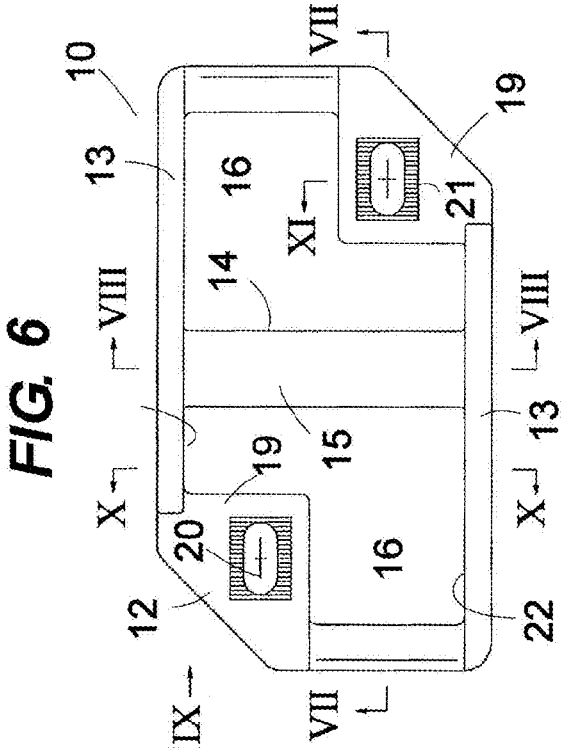
FIG. 6 is a top view of the base frame of the assembly.

The base frame 10 as best shown in FIGS. 6-11 has a generally planar and horizontal bottom face 11 and is of basically rectangular outline, with two corners 12 beveled off at 45°. Along its longitudinally extending sides the frame 10 has two transversely spaced side members 13 forming upstanding ribs having vertical inner faces 22. A flat bar 14 forming a connecting web bridges the side members 13, has a slightly upwardly convex and horizontal upper face 14, and defines inside the frame 10 a pair of vertically throughgoing L-shaped apertures 16. At its opposite longitudinal ends the frame 10 has end members 17 each extending transversely inward from an end of a respective one of the side members 13 toward the respective beveled-off corner 12. Each short end member 17 has a nearly vertical planar inner end face 18 extending at a small obtuse angle to the plane of the bottom face 11. At each corner 12 the frame 10 is formed with a flat flange piece 19 having a horizontal and upwardly directed upper face and formed with a longitudinally elongated hole or slot 20 surrounded by a field of transversely extending and upwardly directed ridges 21. In normal use the frame 10 is bolted through the holes 20 to a sleeper or anchors in a concrete substrate, with the longitudinal extent of the frame 10 (horizontal in FIG. 1) perpendicular to the rail to be attached atop the assembly.

Figure 17:
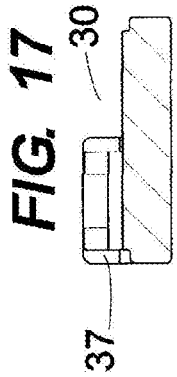
FIG. 17 is a cross section along line XVII of FIG. 12.
Figure 15:
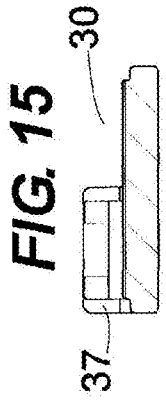
FIG. 15 is a section taken along line XV of FIG. 12.
Figure 16:
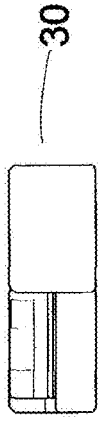
FIG. 16 is an end view taken in the direction of arrow XVI of FIG. 12.
Figure 13:
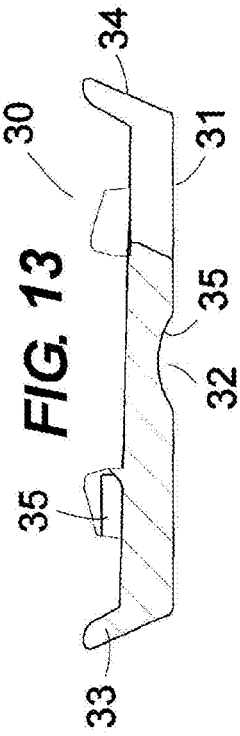
FIG. 13 is a longitudinal section along line XIII-XIII of FIG. 12.
Figure 14:
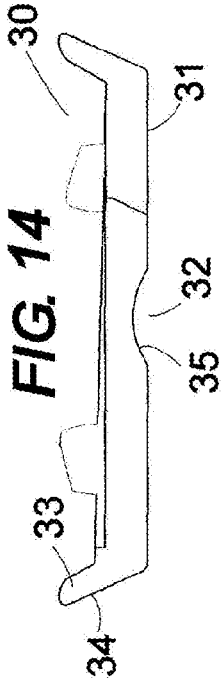
FIG. 14 is a side view in the direction of arrow XIV of FIG. 12.
Figure 12:
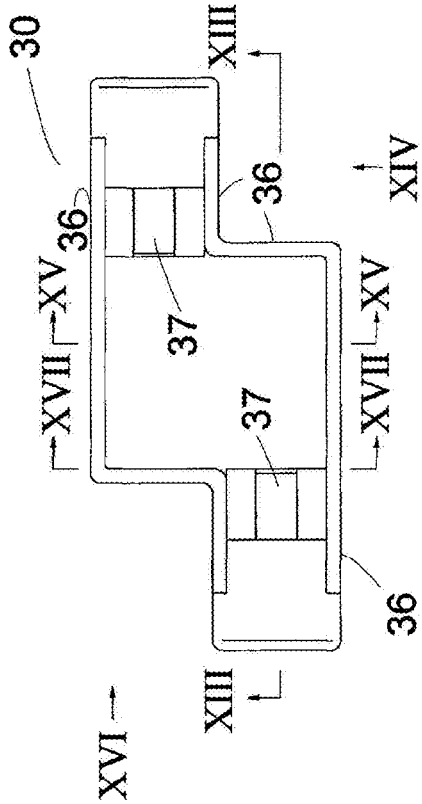
FIG. 12 is a top view of the top plate of the assembly.

As shown in FIGS. 12-17 the top plate 30 is shaped to fit between the side members 13 and between the end members 17, basically over the two apertures 16 and web 14. The plate 30 has a basically planar lower face 31 formed with a central shallow, downwardly open groove 32 having a downwardly concave part-cylindrical face 35 complementary to the upper face 15 of the web 14. It also has vertical edge faces 36 confronting the edge faces 22 of the base frame 10. At its longitudinal ends the plate 30 has upstanding ribs 33 defining outer end faces 34 angled complementarily to the respective inner end faces 18. Inward of each end rib 33 the plate 30 has upwardly projecting formations or eyes 37 that cooperate with rail holddown clips in the manner well known in the art and shown in detail in FIG. 16 of above-cited U.S. Pat. No. 6,986,470.

The elastomeric body 50 completely fills the space between and is bonded to the angled faces 18 and 34 as in the prior-art system. It also completely fills the vertical gap between the longitudinal outer edge faces 36 of the top plate 30 and the inner edge faces 22 of the base frame 10. According to the invention this body 50 is also bonded to the top face 15 of the web 14 and the bottom face 35 of the plate 30 so as to effectively prevent lift-up of this plate 30 from the frame 10.

Figure 20:
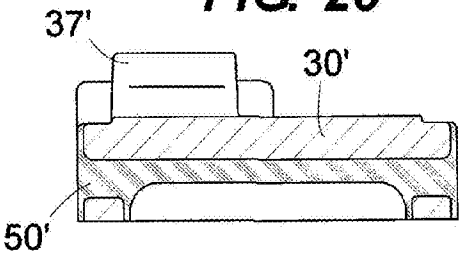
FIGS. 20 and 21 are cross sections along respective lines XX-XX and XXI-XXI of FIG. 18.
Figure 21:
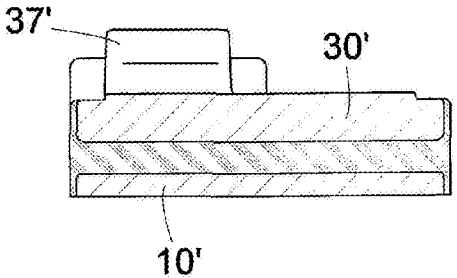
Figure 19:
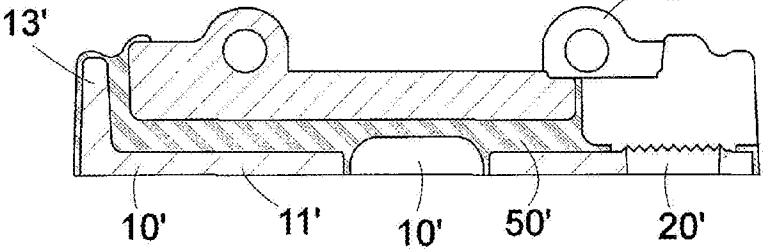
FIG. 19 is a longitudinal section along line XIX-XIX of FIG. 18.
Figure 18:
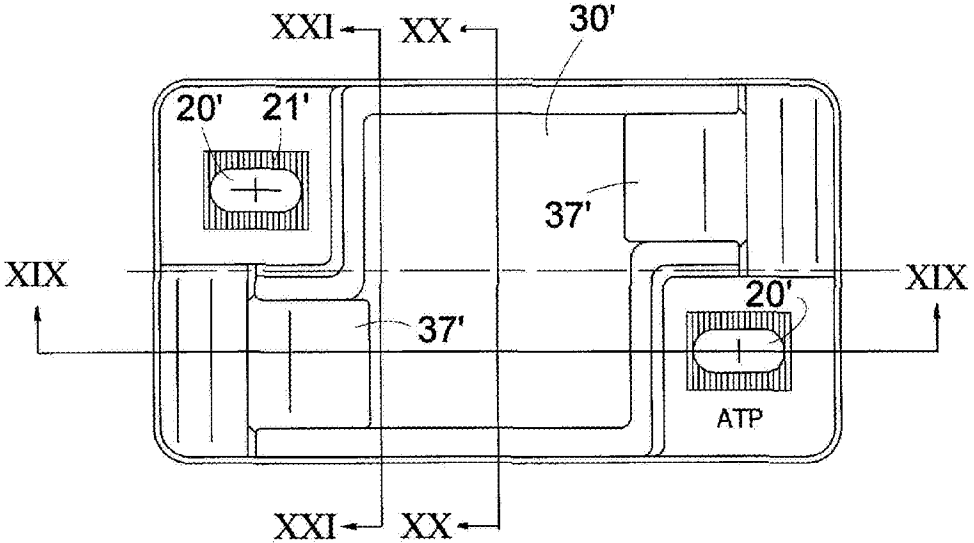
FIG. 18 is a top view of a second assembly according to the invention.
Figure 24:
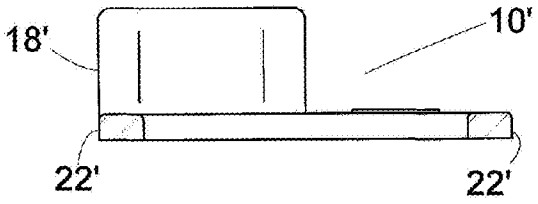
FIGS. 24 and 25 are cross sections taken along respective lines XXIV-XXIV and XXV-XXV of FIG. 22.
Figure 25:
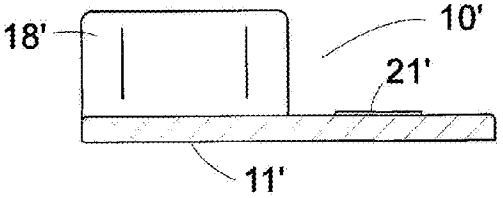
Figure 23:
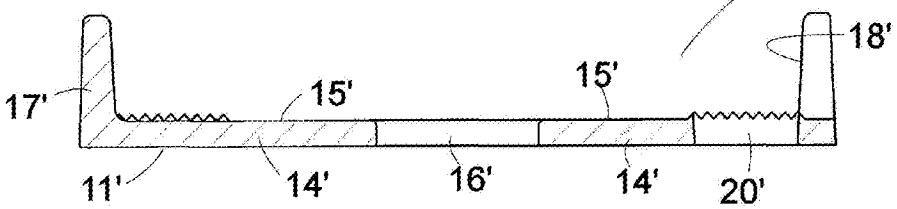
FIG. 23 is a longitudinal section taken along line XXIII-XXIII of FIG. 22.
Figure 22:
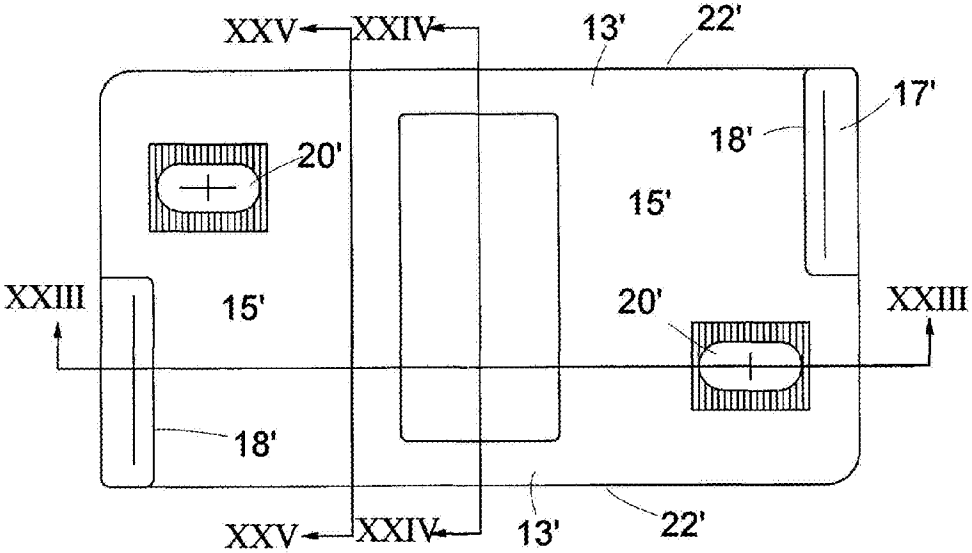
FIG. 22 is a top view of the base frame of the second assembly.
Figure 29:
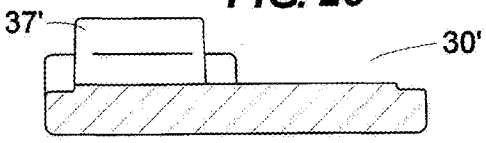
FIG. 29 is a cross section taken along line XXIX-XXIX of FIG. 26.
Figure 27:
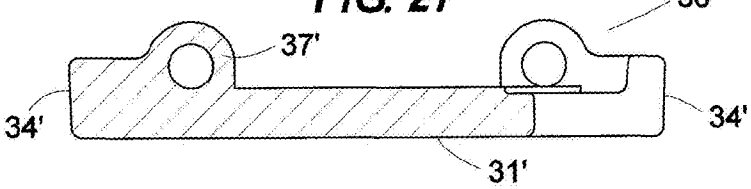
FIG. 27 is a longitudinal section along line XXVII-XXVII of FIG. 26.
Figure 28:
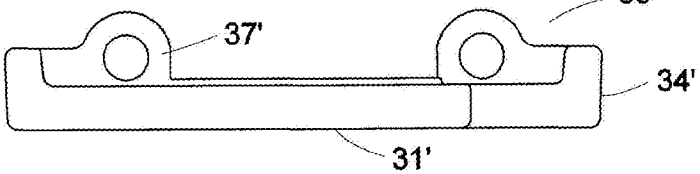
FIG. 28 is a side elevational view taken in the direction of arrow XVIII of FIG. 26.
Figure 26:
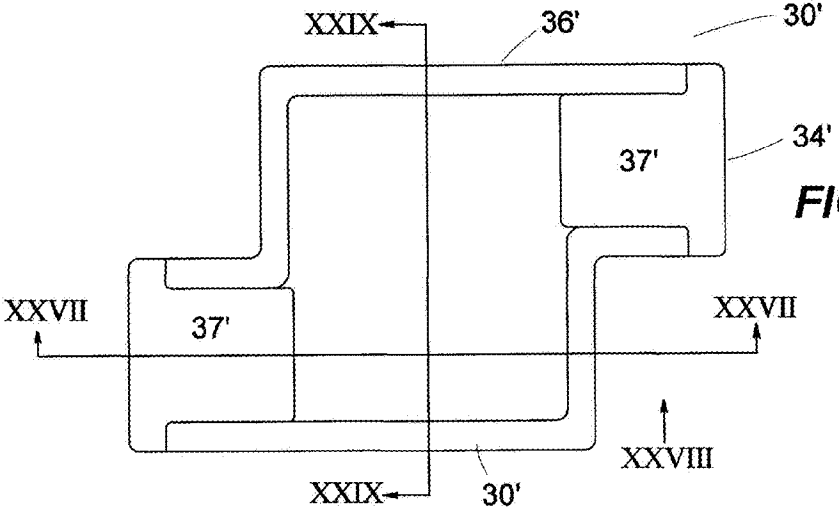
FIG. 26 is a top view of the top plate of the second assembly.

FIGS. 19 through 29 show another assembly where functionally and structurally similar elements are identified with the same references as in FIGS. 1-18, but with primes.

The principal differences in the frame 10' as shown in FIGS. 22-25 are that the diagonally opposite corners where the holes 20' are located are not beveled off, but instead the overall outline of the frame 10' is rectangular. In addition there is only a single central hole 16' of rectangular shape, flanked by two webs 14' having perfectly planar and horizontal upper faces 15' and effectively forming inner extensions of the side and end members 13' and 17'. Furthermore the faces 18' of the end members 17' are virtually vertical, that is within a degree or so of being at 90° to the bottom face. In addition the frame 10' has no structure corresponding to the faces 22 of the upstanding ribs 13 of the first embodiment, and thus the side members 13' here are only clearly defined where they flank the aperture 16'.

The plate 30' as shown in FIGS. 26-29 is of basically the same square Z-shape as in FIGS. 12-17, but instead it has a planar and uninterrupted horizontal bottom face 31' and transverse end faces 34' that are perpendicular to the bottom face 31' or, at most, tipped out slightly like the faces 18'.

Here as in FIGS. 1-17 the elastomeric body 50' completely fills the space between and is bonded to the angled faces 18' and 34' as in the prior art. It is also bonded to the two top faces 15' of the webs 14' to opposite sides of the aperture 16' and to the bottom face 35' of the plate 30' so as once again to effectively prevent lift-up of this plate 30' from the frame 10'.

We claim:

1. A rail-mounting assembly comprising:

a base frame formed unitarily with a pair of transversely spaced and longitudinally extending side members, a pair of longitudinally spaced and transversely extending end members generally bridging ends of the side members and having longitudinally inwardly directed generally vertical inner end faces, and at least one web extending horizontally between the side members, having a substantially horizontal upper face, and defining with the side and end members at least one vertically throughgoing aperture extending transversely from one of the side members to the other of the side members;

a top plate spaced above the base frame and having a downwardly directed lower face having a portion spacedly vertically confronting the upper face of the web, and a pair of respective longitudinally outwardly directed generally vertical outer end faces longitudinally spacedly horizontally confronting the inner end faces of the end members; and an elastomeric body substantially filling between and bonded to each of the outer end faces and the respective confronting inner end face, and the upper face of the web and the portion of the lower face confronting the upper face.

2. The assembly defined in claim 1 wherein there are two of the apertures, and the web extends transversely between the side members spacedly between the end members and defines a respective one of the apertures with each of the end members.

3. The assembly defined in claim 2 wherein the web is centrally located between the two end members.

4. The assembly defined in claim 2 wherein the web upper face is upwardly convex, the portion of the lower face being complementarily downwardly concave.

5. The assembly defined in claim 1 wherein there are two of the webs and the aperture is between the two webs.

6. The assembly defined in claim 5 wherein each of the webs forms a longitudinal inward extension of the respective end member.

7. The assembly defined in claim 5 wherein each web has a planar upper face and the lower face has two of the portions that are also planar.

8. The assembly defined in claim 1 wherein each of the end faces forms a small acute angle with the vertical.

9. The assembly defined in claim 1 wherein the body is bonded by vulcanization.

10. The assembly defined in claim 1 wherein the plate and frame are of steel.

11. The assembly defined in claim 1 wherein the top plate is provided with formations for clipping a rail to the top plate.

12. The assembly defined in claim 1 wherein the frame is formed with two throughgoing holes by means of which it can be bolted to a substrate.

13. The assembly defined in claim 12 wherein the frame is generally rectangular and the holes are at diagonally opposite corners.

14. The assembly defined in claim 1 wherein each of the side members extends a major portion of a full length of the base frame between ends of the end members thereof.

15. A rail-mounting assembly comprising:

a base frame formed unitarily with a pair of transversely spaced and longitudinally extending side members, a pair of longitudinally spaced and transversely extending end members generally bridging ends of the side members and having longitudinally inwardly directed generally vertical inner end faces, and at least one web extending horizontally transversely between the side members at a spacing from the end members, having a substantially horizontal and upward convex upper face, and defining with each of the end members a respective vertically throughgoing aperture;

a top plate spaced above the base frame and having a downwardly directed lower face having a downwardly concave portion spacedly vertically confronting and complementary to the upper face of the web, and a pair of respective longitudinally outwardly directed generally vertical outer end faces longitudinally spacedly horizontally confronting the inner end faces of the end members; and an elastomeric body substantially filling between and bonded to each of the outer end faces and the respective confronting inner end face, and the upper face of the web and the portion of the lower face confronting the upper face.

* * * * *